United States Patent [19]

Holder et al.

[11] Patent Number: 4,637,571

[45] Date of Patent: Jan. 20, 1987

[54] ELECTRONIC IMAGE STABILIZATION

[75] Inventors: Donald W. Holder, Huntsville; William R. Phillips, Hazlegreen, both of Ala.

[73] Assignee: The United States of America as represented by the Secretary of the Army, Washington, D.C.

[21] Appl. No.: 771,751

[22] Filed: Sep. 3, 1985

[51] Int. Cl.[4] ..... F41G 7/22

[52] U.S. Cl. ..... 244/3.16; 244/3.11

[58] Field of Search ..... 244/3.16, 3.15, 3.14, 244/3.11

[56] References Cited

U.S. PATENT DOCUMENTS

| | | | |
|---|---|---|---|
| 3,718,293 | 2/1973 | Willems et al. | 244/3.16 |
| 3,743,215 | 7/1973 | Harris | 244/3.14 |
| 3,920,199 | 11/1975 | Woodworth et al. | 244/3.14 |
| 4,033,525 | 7/1977 | Leonard et al. | 244/3.15 |
| 4,060,830 | 11/1977 | Woolfson | 244/3.11 |
| 4,198,015 | 4/1980 | Yates et al. | 244/3.15 |
| 4,277,038 | 7/1981 | Yates et al. | 244/3.15 |
| 4,474,343 | 10/1984 | Zwirn et al. | 244/3.11 |

OTHER PUBLICATIONS

Dickson, "A Camera Designed Just for Vision" Photonics Spectra, Apr. 1985, pp. 107, 108, 110 and 112.

"Camera Tube", RCA Electronic Components Specification Sheet printed 4/75.

*Primary Examiner*—Charles T. Jordan

*Attorney, Agent, or Firm*—Jr. Garvin; Freddie M. Bush

[57] ABSTRACT

In an optical guidance system, body fixed electronic image stabilization of television imaging is used to allow strapdown seeker guidance in a missile. Electronic image stabilization eliminates the need for a stabilized sensor or seeker platform while providing the same line-of-sight information that would have been obtained from the platform. Body fixed electronic image stabilization compensates for routine vibrational and rotational motion experienced by a missile airframe during flight. This compensation is accomplished by deliberately underscanning the camera and driving the camera's deflection coils with signals from pitch and yaw body rate sensors on the missile. The image developed on the camera detector raster is thereby moved in an equal and opposite direction to the sensed, experienced, motion during the same instant that the motion is occuring. Compensation thus stabilizes the resultant image, which would otherwise be a blur of motion on the display screen.

6 Claims, 14 Drawing Figures

ELECTRONIC IMAGE STABILIZATION

DEDICATORY CLAUSE

The invention described herein may be manufactured, used, and licensed by or for the Government for governmental purposes without the payment to us of any royalties thereon.

BACKGROUND OF THE INVENTION

All missile systems require some form of guidance during all or at least some portion of their flight from launch until target impact. Within these guidance schemes there are a group or class of missile systems that are programmed to guide themselves, i.e., there is no external influence such as an operator giving directional commands. These self-guided missiles usually include a stablized seeker platform for maintaining line-of-sight between the missile and the target and automatically provide directional control signals from the missile autopilot to the missile control surfaces actuators. The stable platform is usually an electro-mechanical stablized seeker platform that isolates the seeker head from vibrational and rotational motion that is routinely experienced by the missile airframe during flight. Proportional navigation for terminal guidance is typical of these guidance schemes. Examples of a variety of guidance schemes is shown in U.S. Pat. No. 4,198,015 and U.S. Pat. No. 4,277,038 both issued to R. E. Yates et al. These patents disclose several guidance schemes used in trajectory shaping of missiles and terminating in terminal guidance prior to impact. Such systems require the electro-mechanical stablized seeker platform which provides very accurate guidance but also represents a significant portion of the cost of the guidance systems. Part of the high cost is the requirement for precision components that are also rugged enough to withstand the flight environment.

SUMMARY OF THE INVENTION

Electronic image stabilization provides electronic stabilization of television (TV) imaging in a body-fixed sensor for strap-down seeker guidance. Electronic image stabilization is a purely electronic means for obtaining the same line-of-sight (LOS) information that is routinely obtained from electro-mechanical stabilized platforms and eliminates the need for the platforms. Stability is brought about by under scanning a standard TV camera and a missile seeker system and driving the camera's deflection coils with signals that are obtained from missile-borne body rate sensors. The body rate sensors detect pitch and yaw rate information. This compensation causes the image that is developed on the camera detector's raster to be moved in an equal and opposite direction to any sensed vibrational or rotational motion that occurs. Thus, a target image that would otherwise be observed as a blur motion on a display screen is stabilized, being prevented from moving in either the direction of sensor motion or in the opposite direction of compensation. This compensation allows the relative position of the target along the missile-target LOS to remain centered between the extremes generated by, for example, a momentary vibration in one direction and the compensating signal in the opposite direction away from the LOS axis. Thus, the missile guidance system receives a stable guidance signal indicative of true pitch and yaw LOS of the missile with respect to the target, while the undesirable vibrational and rotational signals are eliminated.

DESCRIPTION OF THE PREFERRED EMBODIMENT

Figure 1:
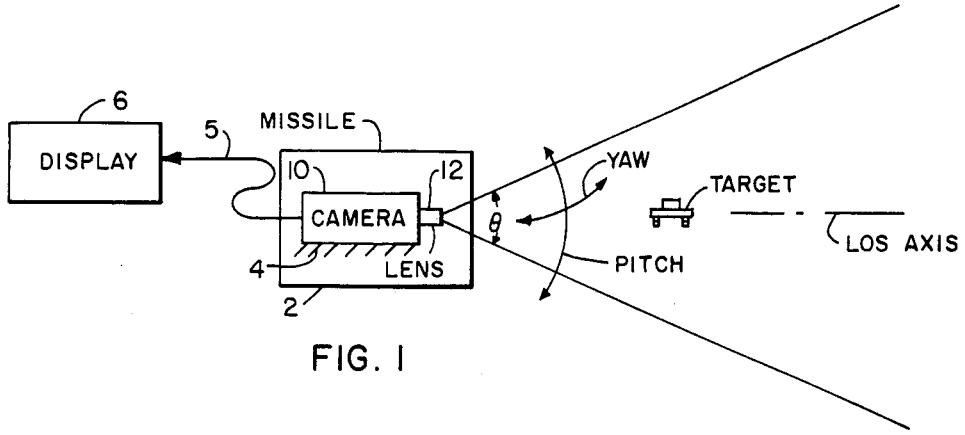
FIG. 1 is a typical diagram of the seeker or sensor of a missile system with a target in the field of view.

Referring now to the drawings wherein like numbers refer to like parts, as shown in FIG. 1 a missile 2 has a seeker or sensor therein defined as a camera 10 with lens 12. Camera 10 is disposed to have a particular look angle (theta) or field-of-view that is shown as being bisected by the LOS axis. Camera 10 is body-fixed 4 to the frame of missile 2 so that any directional change in missile trajectory results in a corresponding change in the LOS axis of the camera. Generally, the LOS axis of the camera may be considered to be the same as the missile longitudinal axis but this need not always be the case and it is routinely compensated for as is well established in the prior art. An output from camera 10 is shown coupled via a optical link 5 to a remote display circuit 6. The output of camera 10 may be coupled via link 5, alone or with other signals to a fixed ground station for observation by an operator or for other purposes, allowing ground personnel to observe the image that is seen by the camera. Alternatively or/and in conjunction with the output signals 5 the output of camera 10 may be coupled internally for automatic guidance signals.

Figure 2:
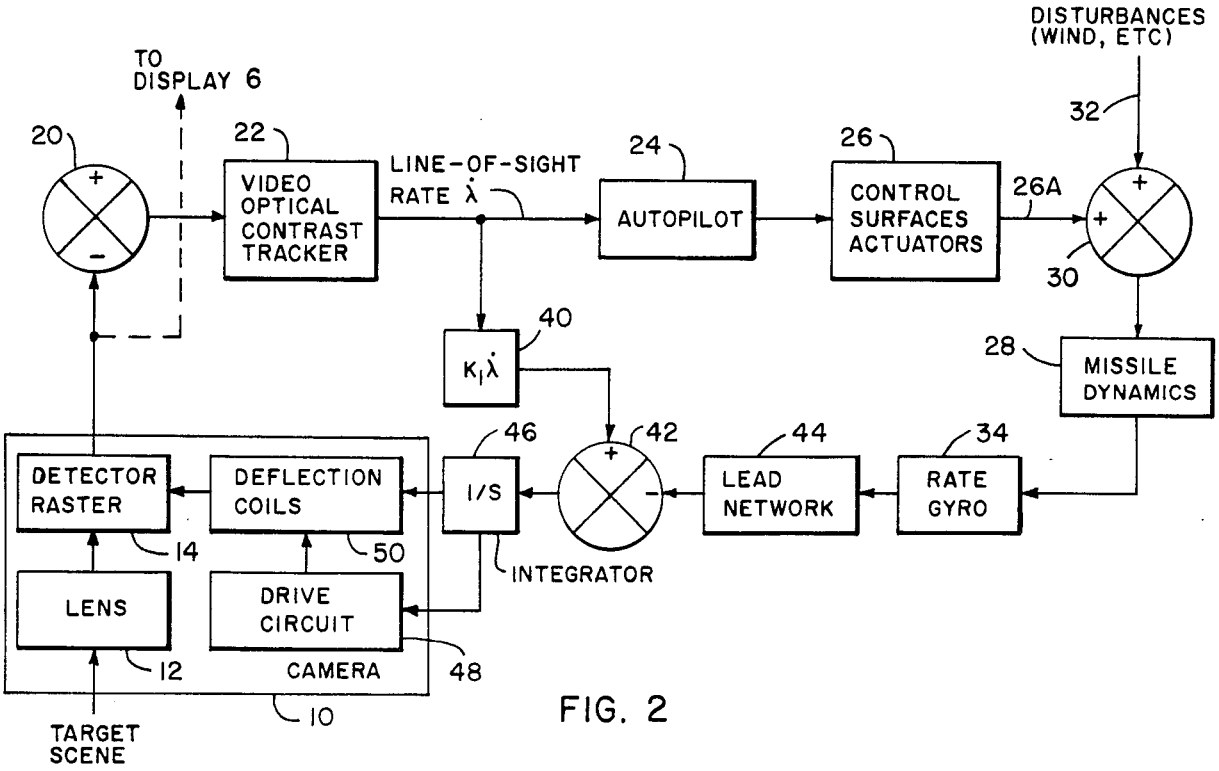
FIG. 2 is a preferred embodiment and simpified block diagram of the electronic image stabilization system for a missile system.

FIG. 2 discloses a block diagram of one channel of an electronic image stabilization system and missile guidance and control circuitry for providing stabilized guidance signals. FIG. 2 is typical of either pitch or yaw control. Thus two of these circuits are required for complete guidance. FIG. 2 is described with respect to pitch and it is recognized that yaw control is substantially identical thereto. In the system, the missile seeker or camera 10 is disposed for receiving a target scene through lens 12. An output image from lens 12 is directed to modulate the raster of a detector 14 such as a vidicon that subsequently provides an output to an optical signal processor or mixer 20. This signal is coupled to tracker 22 which provides a line-of-sight rate output that is coupled to the missile auto-pilot 24 for driving the missile control surfaces actuators 26 which control the missile fins (not shown) and the missile direction along the LOS. An output signal from the control surfaces actuator circuitry 26 is fed back to the missile dynamics 28 by way of a signal processor or mixer 30. External disturbances on the missile that cause vibration or rotation (such as wind and inherent, internal vibration) are coupled as inputs 32 to the processor 30 and are combined with the outputs 26A of the control surfaces actuators. This composite signal is coupled to missile dynamics 28. The output of missile dynamics 28 is sensed by the pitch rate gyro 34.

The line-of-sight rate output of tracker 22, in addition to being coupled to autopilot 24, is also multiplied by a constant $K_1$ in multiplier circuit 40 and subsequently coupled to another mixer 42. The output of rate gyro 34 is coupled through a lead network 44 to mixer 42 where it is combined with the output from multiplier 40 and coupled to another integrating network 46. The lead network 44 has the form $KS/1+\tau S$, where K is the gain factor and is constant, S is the LaPlace transform operator, and $\tau$ is the time constant of the system. The output of integrating network 46 is coupled as an input to camera 10, being coupled to a drive circuit 48 for driving the camera's deflection coils 50. Coils 50 respond to the input signal to provide an output to detector raster 14.

Figure 3A:
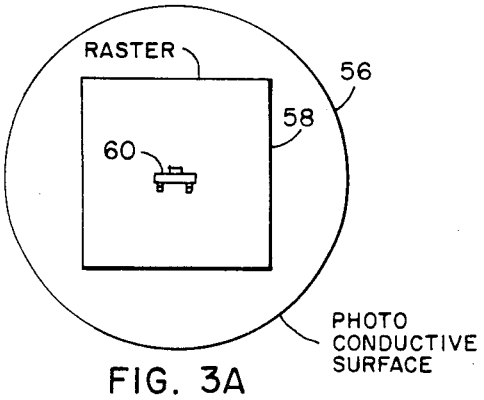
FIGS. 3A, 3B, 3C, 3D and 3E depict the photoconductive surface of the TV camera tube images, showing the typical target image (3A), a reduced raster image (3B), a reduced raster and target image (3C), an uncompensated target motion image (3D), and a raster motion to compensate for the target motion image (3E).
Figure 4A:
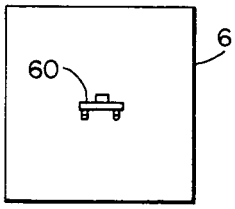
FIGS. 4A, 4B, 4C, 4D, and 4E depict the television monitor display that may actually be seen by an observer and which is coupled to the tracker for guidance for the conditions shown respectively in FIGS. 3A–3E.

When a typical, unmodified, camera views a target scene, such as that of FIG. 1, the camera operates with a normal scanning raster. FIG. 3A depicts a photoconductive surface 56 of such a typical camera tube, disclosing the normal scanning raster 58 with a target image 60. FIG. 4A discloses display 6 or a television screen that displays the target image 60. This same image that is present on the TV monitor 6 is provided to the video tracker 22 of FIG. 2.

Figure 3B:
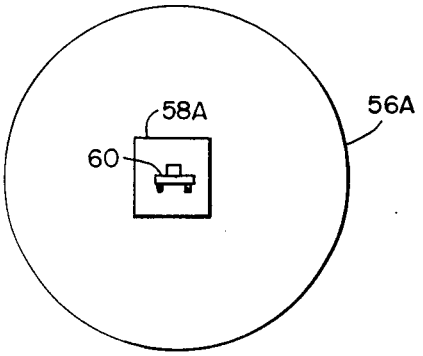
Figure 4B:
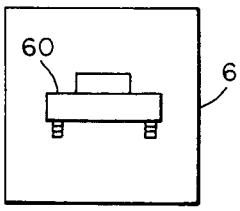

FIG. 3B illustrates a particular target scene as viewed by a modified camera. However, the scanning raster 58A is reduced by a factor of four to one (4:1) over that of FIG. 3A. The same scene information is passed or coupled by the camera optics to the photoconductive surface 56A but, with the 4:1 electronic zooming that has taken place, only 1/16 of the original scene is being utilized. However, as shown in FIG. 4B, the target 60 as viewed on the monitor 6 has been magnified by a factor of 4 with respect to the monitor raster. To restore the original target/raster size ratio, the camera lens optical FOV must be increased by the same ratio (4:1). This is done by using a lens (FIG. 1, lens 12) that has a field of view 4 times that which was originally used with the camera.

Figure 3C:
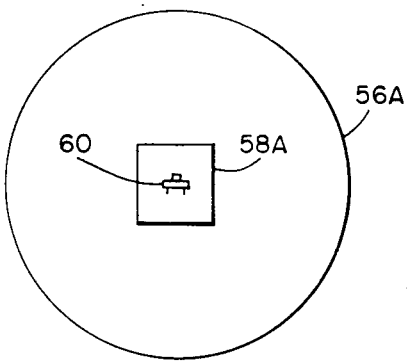
Figure 4C:
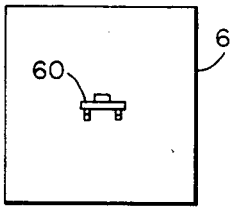

By utilizing the hereinabove noted, factors (electronic zoom down of scanning raster by 4 to 1, camera lens optical FOV increased by 4 to 1) the target actually appears to the tracker and on the TV monitor 6 (if used) as it did for the normal raster size depicted in FIG. 3A. FIGS. 3C and 4C disclose this normal target size for the reduced raster.

Figure 3D:
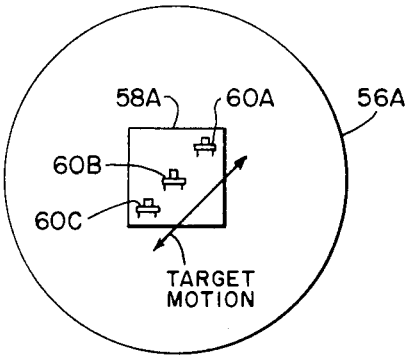
Figure 4D:
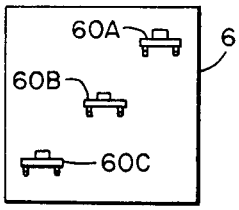

Since the sensor is body fixed, any vibration that affects the missile, will also cause the sensor to vibrate. With no correction, this vibration in turn causes the target image 60 to appear to be moving. FIGS. 3D and 4D depict this undesired movement. In FIG. 3D the target is shown at three points along a diagonal path. Target positions 60A denotes one extreme, 60C the other extreme, and 60B the central point. In reality the target images blur along the line of movement. In FIG. 3D the diagonal line of motion depicts presence of pitch and yaw motion. A vertial line of motion would depict only pitch motion; a horizontal line, only yaw motion. The motion is depicted on the reduced size scanning raster 58A. The TV tracker 22 and the TV monitor 6 will also receive (or see) this apparent blurring, diagonal motion of the target, as shown in FIG. 4D.

Figure 3E:
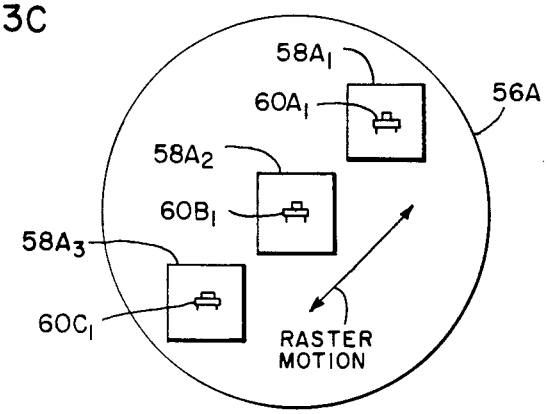
Figure 4E:
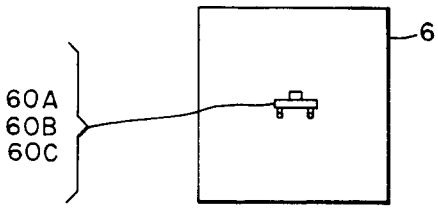

However image stabilization according to FIG. 2, prevents the distorted, blurred, image of FIGS. 3D and 4D from occuring. With the electronic image stabilized camera undergoing the hereinabove noted pitch and yaw motion, the motion is sensed by the body pitch and yaw rate gyros (34), respectively. The outputs from these gyros are coupled to respective lead networks (44) that compensate for phase shifts in the particular gyro's response. The compensated (pitch and yaw) rate gyro outputs are integrated in integrator 46 for position, and then used to drive the respective vertical and horizontal deflection coils of the camera. The coils are driven to dynamically and instantaneously reposition the scanning raster 58A on the detector 56A surface in the opposite direction to that of the apparent motion. Thus, without compensation, the target as shown in FIGS. 3D and 4D, appears to move (for example) diagonally from right to left as 60A, 60B, and 60C for one line of motion. In reality this represents missile motion. Thus, for example, with the target image at position 60B in FIG. 3D, vibration of the missile that tilts the sensor downward diagonally would cause the target to move to position 60A. Tilting the sensor upward diagonally would cause the target to appear at position 60C. However, as shown in FIG. 3E, the electronic compensation, via the rate gyro sensed motion of the missile, causes an equal and opposite motion electronically so that the target image is electronically moved to $60A_1$ an equal distance in the opposite direction to the missile movement at the same instant that the optical image 60A, is seen on the vibrated camera. Since the motion detected optically in one direction is compensated for electronically in the opposite direction, the effect of the motion is nulified, and no apparent target motion is noticed on either the TV monitor or in the tracker. This is shown in FIG. 4E. The target motion with respect to the scanning raster is effectively cancelled.

To provide the electronic deflection an existing camera tube 10 was modified. The particular modification performed can vary somewhat from camera to camera depending on the particular electronics of various manufacturers' cameras. It is only necessary to reduce the camera scanning raster electronically, compensate for the reduction by increasing the camera lens FOV, and then provide the image stabilization by electronically shifting the camera raster equally and in the opposite direction to detected motion. For an RCA Model TC2000 silicon vidicon camera the circuit changes were as shown in FIGS. 5 and 6.

Figure 5:
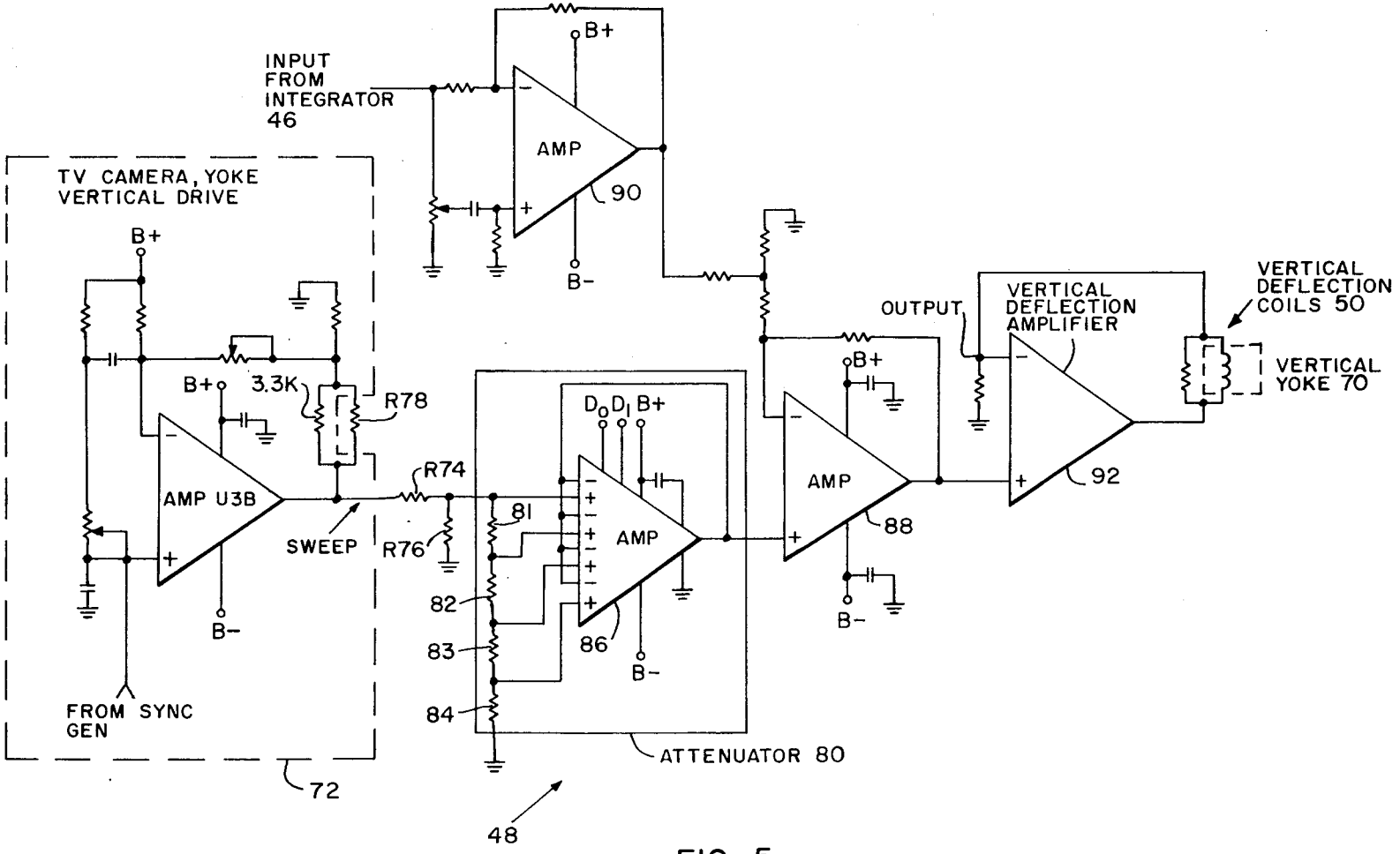
FIG. 5 is a schematic of a particular vertical deflection circuit for obtaining underscan and raster dynamic control by a particular television camera.
Figure 6:
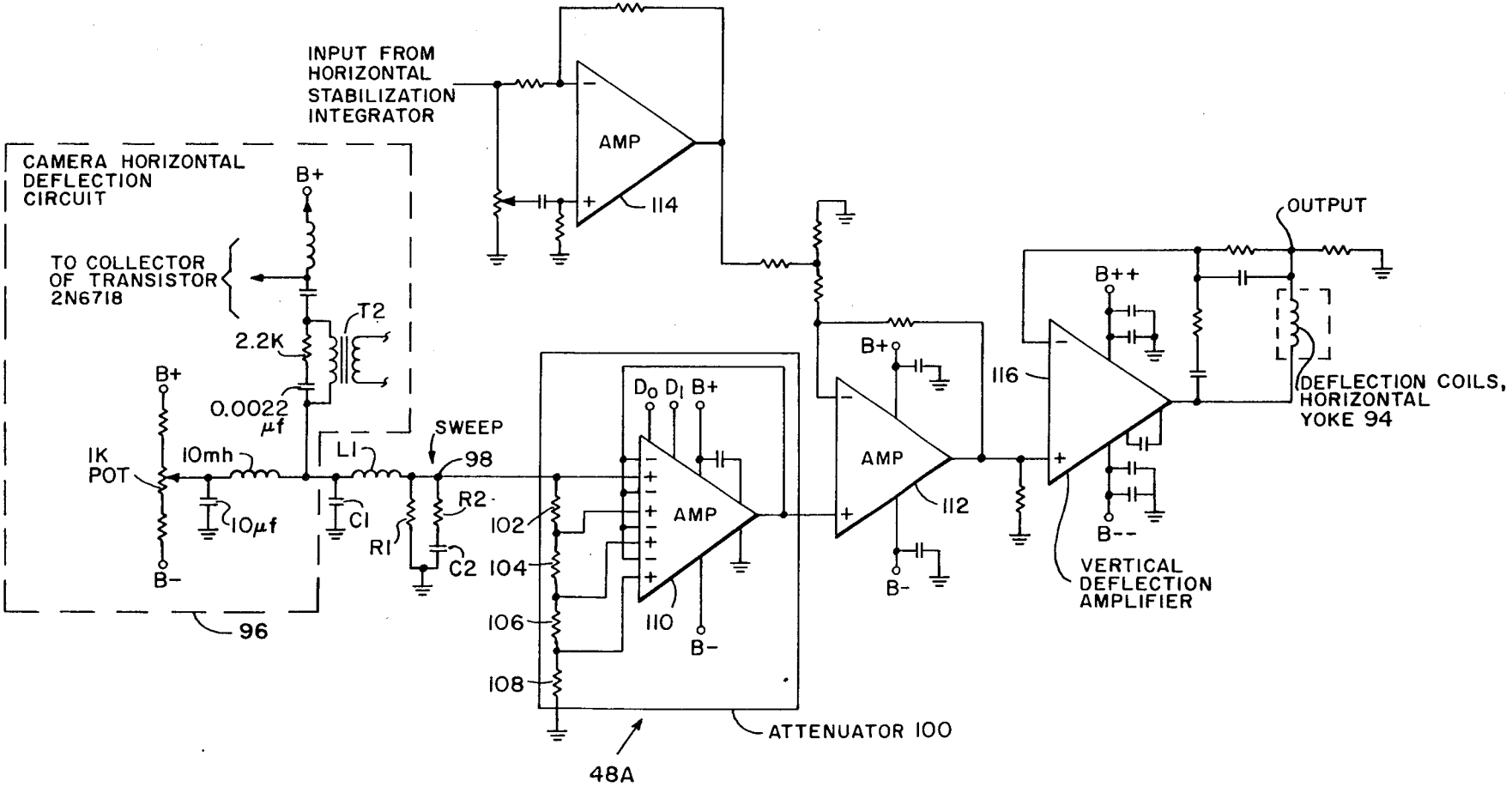
FIG. 6 is a schematic of a particular horizontal deflection circuit for obtaining underscan and raster dynamic control by a particular television camera.

As shown in FIG. 5, the vertical yoke 70 was disconnected from the original camera vertical deflection amplifier circuit 72 and replaced with drive circuit 48. In drive circuit 48 a voltage divider consisting of R74 and R76 are coupled to the U3B amplifier of the camera and the amplifier's gain was decreased by adding a 150 ohm resistor, R78, in parallel with the 3.3 K ohm resistor in the amplifier's feedback path. A negative-going ramp representing the raster vertical size for the camera can be viewed with an oscilloscope at the junction of R74 and R76. This signal is the input to a programmable, non-inverting four-state attenuator 80. As shown attenuator 80 comprises 4 resistors 81, 82, 83, and 84, and an amplifier 86. The resistors are connected in series for selectable signal coupling therethrough to amplifier 86. The attenuator provides gains of 1, ½, ⅓, and ¼ respectively, representing vertical electronic zoom ratios of 1:1, 2/1, 3:1, and 4:1.

The gain of the attenuator is controlled by the logic levels on inputs $D_0$ and $D_1$ coupled to amplifier 86. The particular logic level (or gain) of attenuator 80 is thus controlled by a pair of bias voltage inputs ($D_0$ and $D_1$) which are selected and locked-in prior to missile launch. Table I shows a truth table of the selectable voltages that can be applied to $D_0$ and $D_1$ and the resultant logic level or gain of the attenuator.

TABLE I

| $D_0$ | $D_1$ | GAIN |
|---|---|---|
| 0 | 0 | 1 |
| 5 volts | 0 | 2 |
| 0 | 5 volts | 3 |
| 5 volts | 5 volts | 4 |

The output of amplifier 86 of attenuator 80 is coupled to a summing amplifier 88. At amplifier 88 the signal is combined with a compensated vertical analog control voltage for vertical positioning. This control voltage is coupled from amplifier 90 to the negative input of amplifier 88. The result at the output of amplifier 88 is a ramp voltage with a DC voltage reference level that is dependent on the value of the vertical analog control voltage. This signal is coupled to an amplifier 92, the new vertical deflection amplifier which drives vertical yoke 70. The amplifier 90 receives its input from integrator 46. This input is the combined sum of the outputs from integrated tracker pitch LOS rate and the pitch rate gyro lead network.

Similarly as shown in FIG. 6, the horizontal yoke 94 was disconnected from the original camera horizontal deflection circuitry 96 and replaced with a drive circuit 48A. Drive circuit 48A is similar to the vertical drive circuit 48. In drive circuit 48A an RLC network consisting of capacitors C1 and C2, inductor L1, and resistors R1 and R2 are coupled to transformer T2 and through a 10 millihenry inductor to adjustable potentiometer (1K pot) in the existing camera horizontal deflection circuitry 96. A negative-going ramp representing the raster horizontal size for the camera can be viewed with an oscilloscope at the junction 98 of R2 and Rl. This signal is the input to a programmable, non-inverting four-state attenuator 100. As shown, attenuator 100 has four resistors 102, 104, 106, and 108 and an amplifier 110. The resistors are connected in series for selectable signal coupling therethrough to amplifier 110. The attenuator provides selectable gains of 1, $\frac{1}{2}$, $\frac{1}{3}$, and $\frac{1}{4}$ respectively. These gains represent horizontal electronic zoom ratios of 1:1, 2:1, 3:1, and 4:1. The gain of attenuator 110 is selectable in the same manner as that for attenuator 80, using Table I as noted hereinabove, by controlling logic levels applied to the attenuator amplifier circuit. The output of amplifier 110 of attenuator 100 is coupled to a summing amplifier 112. This signal is combined in amplifier 112 with a compensated horizontal analog control voltage for horizontal positioning. The control voltage is coupled from amplifier 114 to the negative input of amplifier 112. The result at the output of amplifier 112 is a ramp voltage with a DC voltage reference level voltage. This signal is coupled to an amplifier 116, a high current amplifier which is now used to drive the horizontal yoke 94.

Amplifier 114 receives its input from the horizontal integrator (similar to element 46 of FIG. 2). This input is the combined sum of the outputs from integrated tracker yaw LOS rate and the yaw rate gyro lead network.

The circuit components used to modify the vertical and horizontal deflection circuits of FIGS. 5 and 6 are established technology. Typical components with reference to FIGS. 5 and 6 are:

| Element | Reference Number | Description |
|---|---|---|
| 86,110 | HA1-2400-2 | Programmable Analog Attenuator, Harris Corporation |
| 88,92, 112, 114 | LF353N | National Semiconductor, wide bandwidth Dual JFET input, Operational Amplifier |
| 90 | HA5135-5 | Harris Operational Amplifier |
| 116 | PA 09A | Apex Power Operational Amplifier |

Although a particular embodiment and form of the invention has been described, it will be obvious to those skilled in the art that modifications may be made without departing from the scope and spirit of the foregoing disclosure.

We claim:

1. In a target tracking system wherein a television image of a target is used for guidance of a missile toward the target, a method of compensating for undesirable missile body motion and providing a stable television image output from the television camera to the missile target tracker, comprising the steps of:

rigidly mounting a video camera to the missile body;

directing the camera lens along a field-of-view that is referred to the missile longitudinal axis;

deriving a television image of a target within the field of view;

sensing missile body disturbances;

providing missile pitch and yaw angular velocity signals in response to said disturbances;

processing said angular velocity signals;

coupling said processed angular velocity signals to a television camera's vertical and horizontal deflection coils and; moving the camera scanning raster of the television camera in the opposite direction of undesirable missile body motion for providing said stable image output to the missile target tracker.

2. A method of compensating for undesirable missile body motion and providing a stable image output from a television camera to a missile target tracker as set forth in claim 1, and further comprising the steps of:

summing a line-of-sight, pitch and yaw, rate output from the tracker with respective of said processed pitch and yaw angular velocity signals; and integrating the respective summed signals prior to the step of coupling.

3. A method of compensating for undesirable missile body motion and providing a stable image output from a television camera to a missile target tracker as set forth in claim 2, and wherein the step of processing provides error rate damping of the angular velocity signals.

4. In a missile system wherein a missile is directed toward a target and the missile comprises at least a video camera rigidly mounted to the missile body, a rate gyro, a video tracker, and filter compensation circuits; a method of compensating for undesirable missile body disturbances comprising the steps of:

detecting an optical image of a target within the field-of-view of said video camera;

sensing missile body disturbances in pitch and yaw angular velocity with said rate gyros;

tracking the target with an optical contrast tracker to provide a line-of-sight pitch and yaw rate signal for directing missile guidance;

combining the tracker's respective pitch and yaw rates with the rate gyros respective pitch and yaw rates; and driving the video camera's deflection coils to cancel out undesired image motion by moving the camera scanning raster in the opposite direction to the sensed direction of missile body motion.

5. In a target tracking system wherein a television image of a target is sensed by a sensor and used for guidance of a missile in response to the target position within the sensor's field-of-view, the improvement of an electronic image stabilization system for providing a stabilized target image output from the sensor, comprising: an optical sensor for viewing a scene of interest and having an electrical control input and an optical image output; said sensor being body fixed to said missile; a video optical contrast tracker coupled to receive the output of said sensor and for providing a line-of-sight rate output that is indicative of the relationship of a target, within the sensor field-of-view, to the sensor; a missile autopilot responsive to said line-of-sight rate output for directing missile trajectory; pitch and yaw rate gyros fixed to said missile body for providing pitch and yaw angular velocity outputs in response to motion disturbances affecting the missile; means coupled to said rate gyros outputs and to said tracker output for providing integrated outputs of the combined sums of tracker and gyro pitch signals and the combined sums of tracker and gyro yaw signals respectively, said integrated outputs being coupled to provide respective pitch and yaw bias inputs on said control input to drive the optical sensor output in the opposite direction of missile body motion disturbances.

6. In a target tracking system the improvement of an electronic image stabilization system as set forth in claim 5 wherein said optical sensor is a television camera having a lens, vertical and horizontal deflection coils and a video detector, said deflection coils having an output coupled to the video detector for driving the raster scanning lines and the sensor control input being the driving input for said coils; said video detector being a vidicon tube having said optical image output; and said lens being for directing an optical image to the detector raster; and said motion disturbances being vibrational and rotational motions.

* * * * *